US006052920A

United States Patent [19]

Bathum

[11] Patent Number: 6,052,920

[45] Date of Patent: Apr. 25, 2000

[54] SANDAL WITH X-CROSS WEAVE STRAPS

[75] Inventor: Dale Bathum, Mercer Island, Wash.

[73] Assignee: Bite, LLC, Redmond, Wash.

[21] Appl. No.: 09/136,494

[22] Filed: Aug. 19, 1998

Related U.S. Application Data

[63] Continuation-in-part of application No. 29/086,356, Apr. 10, 1998.

[51] Int. Cl.[7] ..... A43B 3/12; A43B 23/02

[52] U.S. Cl. ..... 36/11.5; 36/114; 36/7.5; 36/45

[58] Field of Search ..... 36/114, 11.5, 105, 36/7.5, 45, 58.6, 137

[56] References Cited

U.S. PATENT DOCUMENTS

| | | | |
|---|---|---|---|
| D. 94,638 | 2/1935 | Stritter | 36/11.5 |
| 2,173,702 | 9/1939 | Winkel | 36/11.5 |
| 2,526,940 | 10/1950 | Fello | 36/11.5 |
| 2,724,913 | 11/1955 | Russell | 36/11.5 |
| 4,793,075 | 12/1988 | Thatcher | 36/11.5 |
| 5,465,506 | 11/1995 | Matis et al. | 36/11.5 |
| 5,651,195 | 7/1997 | Clancy | 36/11.5 |
| 5,687,492 | 11/1997 | Muraoka | 36/11.5 |

FOREIGN PATENT DOCUMENTS

| | | | |
|---|---|---|---|
| 1331570 | 5/1963 | France | 36/11.5 |
| 1372586 | 8/1964 | France | 36/11.5 |
| 428127 | 11/1933 | United Kingdom | 36/11.5 |

*Primary Examiner*—Paul T. Sewell
*Assistant Examiner*—Anthony Stashick
*Attorney, Agent, or Firm*—Marvin E. Jacobs

[57] ABSTRACT

A sports sandal having a pair of arc-shaped strips secured to each lateral side of the sandal utilizes a connection means to provide more lateral support. Specifically, the connection means includes a slit on either the front or the rear strip on each lateral side of the sole of the sandal. The strip not having the slit is inserted through the slit thereby providing additional structural support for a wearer's foot. Three straps utilizing Velcro can be employed to adjustably secure the sandal about the user's foot, ankle and heel respectively.

10 Claims, 3 Drawing Sheets

SANDAL WITH X-CROSS WEAVE STRAPS

CROSS-REFERENCE TO RELATED APPLICATION

This application is a continuation-in-part of copending application Ser. No. 29/086,356 filed Apr. 10, 1998.

TECHNICAL FIELD

The invention relates generally to footwear and more specifically to the design of a sandal upper which enhances support and stability.

BACKGROUND OF THE INVENTION

Sandals constitute one of the earliest footwear known to man. Typically, sandals incorporate either a leather or rubberized sole which can be attached to the human foot by straps extending across the Achilles heel, and toes of the user. Prior art sandals were designed for walking; with the straps not particularly designed for anything more stressful than leisure walking. Sandals however, have been recently developed for more demanding sports-related activities as represented by U.S. Pat. No. 5,651,195 ('195) and U.S. Pat. No. 5,687,492 ('492).

The '195 patent discloses a sports sandal utilizing a lace to firmly secure the sandal about a wear's foot. The '492 patent discloses a sandal for use either for walking or with incorporating a cleat for cycling.

Sandals are generally classified as either "closed-heel" or "open-heel".

"Open-heel" sandals are typically provided with a single strap that passes over the wearer's foot above the bridge, or a combination of a strap with a toe-thong that extends from a strap over the bridge of a wearer's foot to the sole of the sandal, and which is generally positioned between two of the wearer's toes.

"Closed-heel" sandals typically include a strap or upper portion positioned behind the wearer's heel to support the wearer's foot within the sandal. The straps are generally not flexible enough for athletic activities and can often chafe or rub the wearer such that the wearer develops blisters or abrasions on the heels.

Both open and closed heel sandals typically provide no support for the ankle of the wearer. Athletic footwear however, typically requires greater support around the ankle and over the top portion of the foot.

Due to the recent commercial interest in sport sandals, there has become a need for a sandal which enhances the structural support provided to a wear's foot without sacrificing comfort.

STATEMENT OF THE INVENTION

The present invention is directed to a sandal which improves upon recent developments related to sports sandals. Specifically, the invention relates to an interconnection of the uppers of a sports sandal which provide additional stability and support without loss of comfort.

The sandal comprises a sole and an upper configuration having: a front pair and a rear pair of support strips, each pair having their respective strips positioned on opposing lateral sides of the sole. Each strip is anchored at both ends to the sole and have a generally arc-shaped configuration. The strips can be anchored by any suitable means for attaching or connecting sandal uppers to the sandal sole.

Each strip is constructed of a durable material; preferably, the desired material is leather although any durable material suitable for footwear may be used. Attached to each strip and facing the other paired strip is a layer of cushion material which is used to provide comfort and eliminate or reduce chafing and other skin irritations which would occur if the user's foot directly came in contact with the strip material. Preferably, the cushion material is tear resistant and elastic. Conventional means of attaching the cushion material to each strip can be used such as stitching or adhesive.

Each strip is connected to: (1) its paired strip on the opposing lateral side and (2) the other strip located on the same lateral side. The means for connecting the paired strips on opposing lateral sides is the cushion material. Preferably, a single piece of cushion material is attached on either end to the respective front lateral side strips and a second single piece of cushion material is attached on either end to the respective rear lateral side strips with the center portion of each cushion material fashioned to contour properly with the top of the user's foot. Preferably, the inside surface area of each strap is entirely covered with the cushion material for maximum comfort. The cushion material not attached to either corresponding strip defines the center portion and further defines an open space between the cushion material and the sole for a user's foot to pass through.

The front and rear strips on each lateral side are connected to one another. The connection of these strips provides more support than if the strips were not connected. Means of connection can include adhesive, staples, rivets or other type of connection known in the prior art. Preferably, the means of connection is accomplished by a cross-weave of the front strip to the corresponding rear strip by providing a slit cut though one strip and its corresponding cushion layer. Preferably, the slit is reinforced by stitching about the slit. During assembly, the end of the strip and its corresponding cushion layer not having the slit are inserted through the slit of the other strip prior to anchoring all strip ends to the sole. This interlocking or weaving of strip material provides additional lateral upper support.

Three straps may also be provided as part of the invention. The first strap is used to tighten and temporarily secure the front pair of opposing lateral strips and corresponding cushion material about the front portion of a user's foot. Likewise, the second strap is used to tighten and temporarily secure the rear pair of opposing lateral strips and corresponding cushion material about the front of the user's ankle. The third strap is used to tighten the rear pair of opposing lateral strips about the user's ankle with the strap wrapping behind the user's heel or Achilles tendon to provide support and prevent the user's foot from slipping out from the rear of the sandal.

Numerous designs of traction can be utilized for the design of the sole bottom depending upon the type of athletic sport. As an example, golf cleats can be designed for attachment to the sole bottom. In addition, an alternative embodiment can include more than two strips on either lateral side so long as each strip member is connected or weaved with the adjacent strip member on the same lateral side.

These and many other features and attendant advantages of the invention will become apparent as the invention becomes better understood by reference to the following detailed description when considered in conjunction with the accompanying drawings.

DETAILED DESCRIPTION OF THE INVENTION

Figure 1:
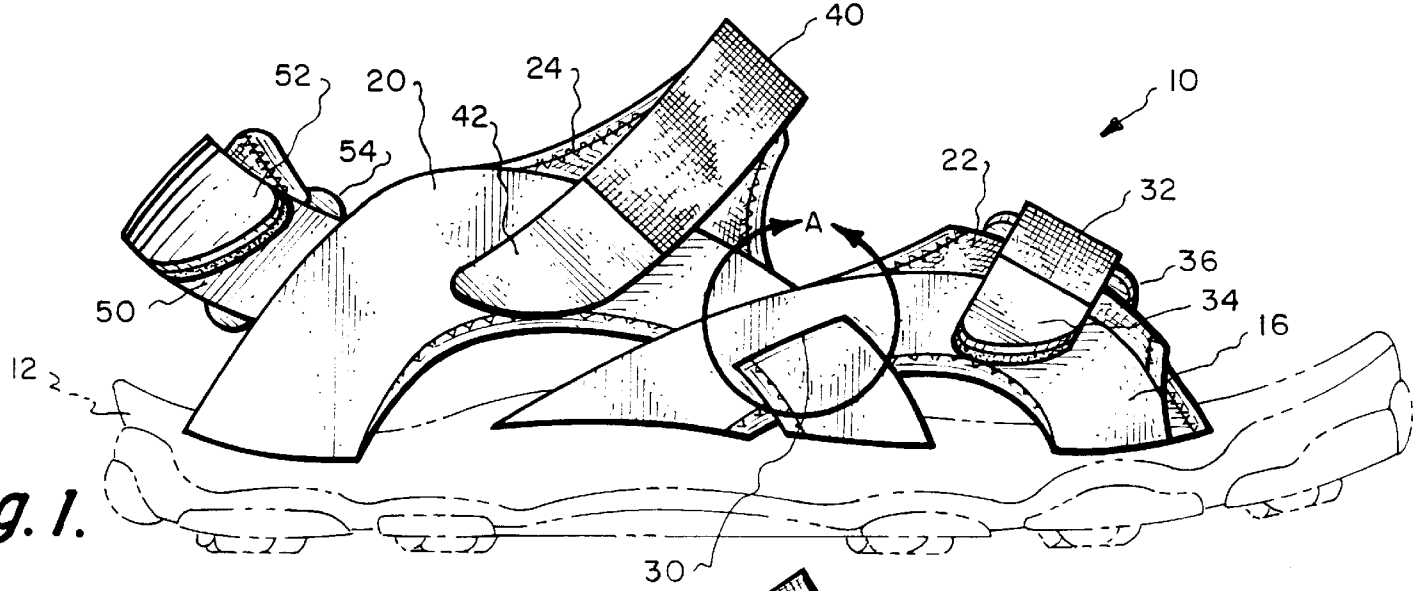
FIG. 1 is a side elevational view of the right side of a sandal.
Figure 2:
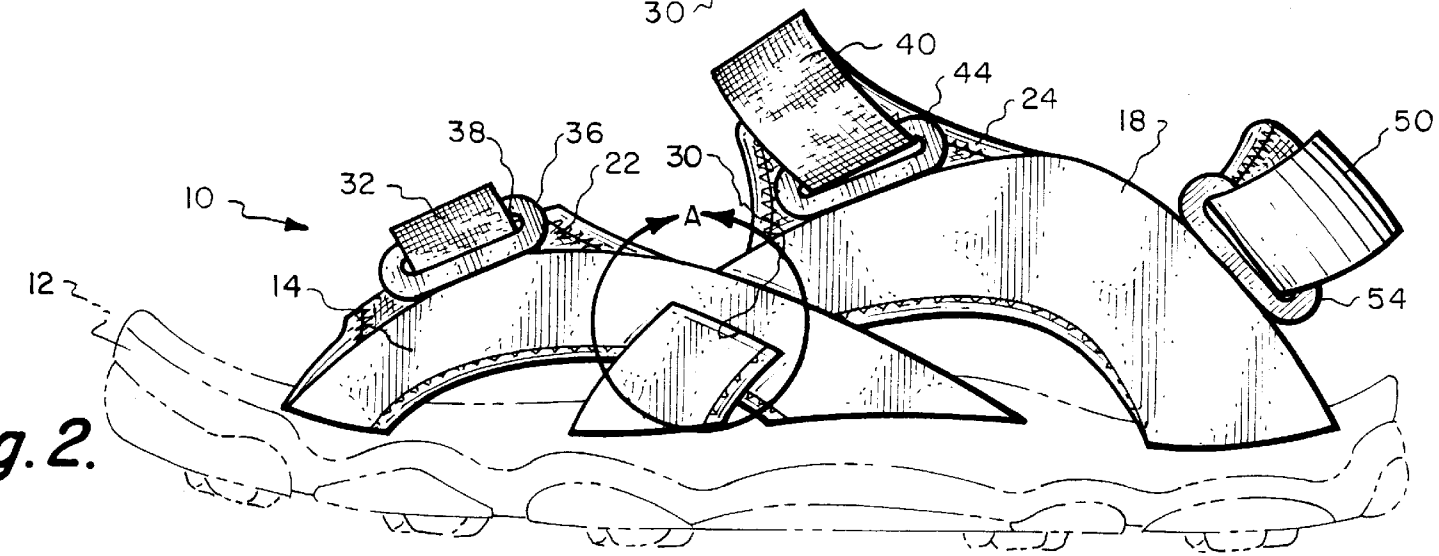
FIG. 2 is a left side view of the sandal shown in FIG. 1.

Referring now to FIGS. 1–5, a sandal 10 according to the invention comprises a sole 12 and an upper configuration having: a front pair of support strips 14 and 16; and a rear pair of support strips 18 and 20, each pair having their respective strips positioned on opposing lateral sides of sole 12. Each strip is anchored at both ends to sole 10 and have a generally arc-shaped configuration. Strips 14, 16, 18 and 20 are constructed of a durable material such as leather.

Figure 3:
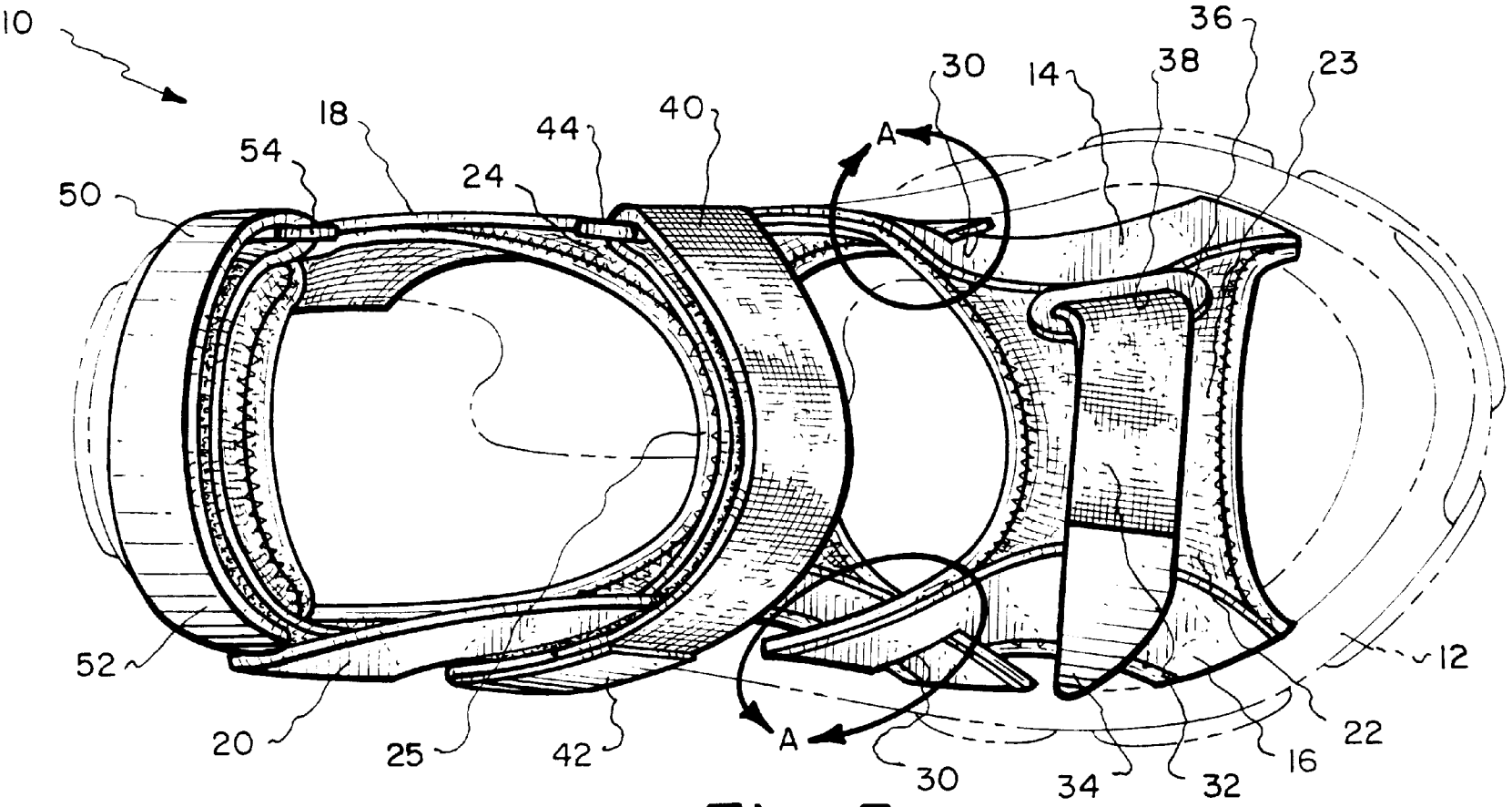
FIG. 3 is a top plan view of the sandal shown in FIG. 1.
Figure 4:
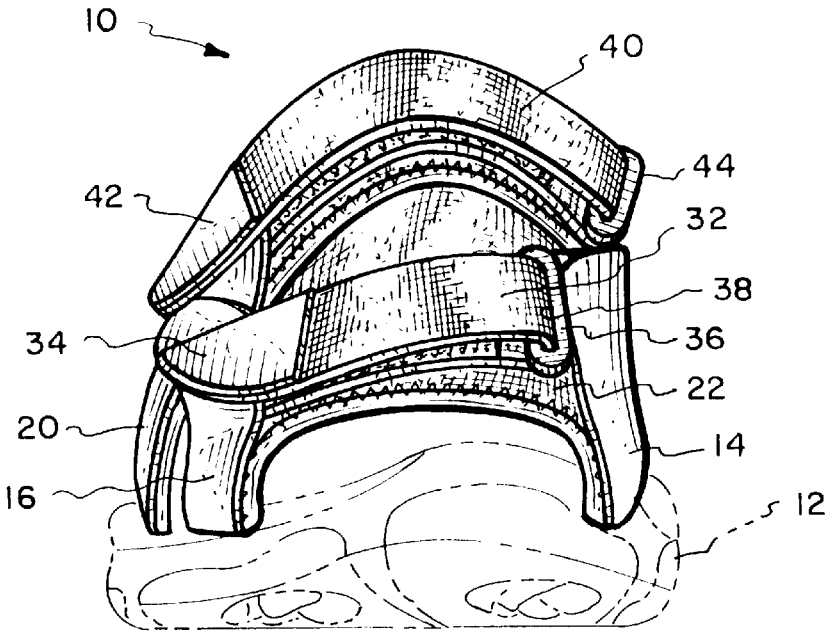
FIG. 4 is a front elevational view of the sandal shown in FIG. 1.
Figure 5:
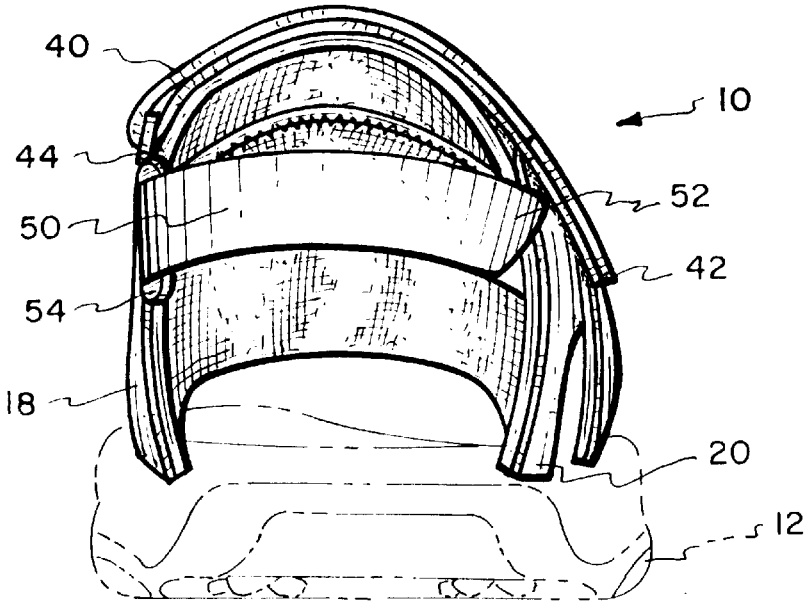
FIG. 5 is a rear elevational view of the sandal shown in FIG. 1.

Attached to the inside surface area of strips 14 and 16 is a layer of tear resistant cushion material 22. Conventional means of attaching cushion material 22 to each strip can be used such as stitching or adhesive. As best illustrated in FIG. 3, the center portion of cushion material 22 is fashioned for comfort and to contour properly with the top of the user's foot. The part of cushion material 22 not attached to either strip 14 or 16 defines a center portion 23 and further defines an open space between cushion material 22 and sole 12 for a user's foot to pass through.

Likewise, attached to the inside surface area of strips 18 and 20 is a layer of cushion material 24. The center portion 25 of cushion material 24 is fashioned for comfort and to contour properly with the top of the user's foot. The part of cushion material 24 not attached to either strip 18 or 20 defines center portion 25 and further defines an open space between cushion material 24 and sole 12 for a user's foot to pass through.

Besides strips 14 and 16 being connected to each other by cushion material 22 and strips 18 and 20 being connected by cushion material 24, the strips on each lateral side of sole 12 are attached to one another; namely front strip 14 to rear strip 18 and front strip 16 to rear strip 20.

The preferred means for connecting the front and rear strips on each lateral side is by a slit 30 cut though one strip and its corresponding cushion layer. There is no preference as to whether slits 30 are in front strips 14 and 16 or on the rear strips 18 and 20. However, for purposes of illustration, slits 30 are located in front strips 14, 16 and their associated cushion layer 22. Rear strips 18, 20 and their associated cushion layer 24 are inserted through their respective slits 30 on front strips 14 and 16 producing an interlocking or weave connection "A" between the respective front and rear strips. The weave connection of strip material depicted as "A" provides additional lateral upper support.

To firmly secure my sandal to a wearer's foot, three straps are utilized; all of which incorporate a hook and loop fastener (such as a Velcro® fastener) affixed to the facing surfaces of each strap as described below.

Front strap 32 is used to tighten the front pair of opposing lateral strips 14 and 16 about the front portion of a wearer's foot. One end of front strap 32 is attached to either lateral strip 14 or 16. Attached to the other lateral strip is a coupling means, most preferably a ring 36 provided with a slit 38. Strap 32 has a free end 34. To temporarily secure front strap 32 when a user's foot is in the sandal, free end 34 of strap 32 is inserted through slit 38 and back across cushion material 22 until the desired snugness is achieved and thereafter, free end 34 couples to the attached end of strap 32 by the use of hook and loop material described above. There is no preference as to the placement of the hook and loop material on either the fixed end or free end of strap 32 so long as the loop and hook material can be engaged to one another to temporarily secure the wearer's foot within the sandal at the desired snugness.

Likewise, an ankle strap 40 is used to tighten the rear pair of opposing lateral strips 18 and 20 about the front of the wearer's ankle. The ankle strap 40 is attached to either rear strip 18 or 20 while the other rear strip has attached a coupling means 44 similar to the coupling means described above for front strap 32. The ankle strap 40 has a free end 42 which is inserted though coupling means 44 and back over itself and temporarily secured by coupling the hook and loop material found on facing surfaces of the ankle strap 40.

The heel strap 50 is used to tighten the rear pair of opposing lateral strips 18 and 20 about the wearer's ankle with the strap wrapping around the wearer's heel or Achilles tendon to provide support and prevent the user's foot from slipping out from the rear of the sandal. As with the ankle strap 40, the heel strap 50 is attached to either rear strip 18 or 20 while the other rear strip has attached a similar coupling means 54 as described for front strap 32. The heel strap 50 has a free end 52 which is inserted though the coupling means and back over itself and temporarily secured by coupling the hook and loop material found on facing surfaces of the heel strap 50.

In an alternative embodiment, the heel strap is attached on one end to one of the rear strips. The free end has hook or loop material. The other rear strip has hook or loop material on its outer surface so that the free end of the heel strap can wrap around the wear's heel and engage the hook or loop material found on the other rear strip.

In a second alternative embodiment, the heel strap incorporates at least two rings, one attached on each rear strip. The heel strap is attached on one of the rear strips, and looped across and through the first ring which is secured to the other rear strip, then back across to the rear strip to which it is attached and looped through a second ring positioned on the rear strip but above the strap end attachment and thereafter across and over to loop material attached on the other rear strip.

Having thus described my invention, it should be appreciated by those skilled in the art that numerous modifications or additions may be made without departing from the spirit and scope of my invention. It is intended that all such modifications and additions fall within the scope of my invention as described in the claims set forth below.

I claim:

1. A sports sandal comprising:

a sole;

a pair of substantially arc-shaped front strips positioned on opposing lateral sides of said sole, the ends of said strips being anchored to said sole;

a pair of substantially arc-shaped rear strips positioned on opposing lateral sides of said sole, the ends of said strips being anchored to said sole;

a layer of cushion material having a first end section, a second end section and a center section, said first end section and said second end section being attached to the respective inside surface of said front strips; said center portion further defining an open space between said cushion material and said sole;

a second layer of cushion material having a first end section, a second end section and a center section, said first end section and said second end section attached to the respective inside surface of said rear strips; said center portion further defining an open space between said cushion material and said sole;

a first means for selectively adjusting said front pair of strips about a wearer's foot;

a second means for selectively adjusting said rear pair of strips about a wearer's ankle;

a strap means for wrapping about the wearer's heel; and a means for connecting said front strip to said corresponding rear strip on the same lateral side of said sole.

2. A sports sandal according to claim 1 wherein said first means comprises a strap having a free end and an end which is attached to the first strip; the other strip further having a ring attached whereby said free end is inserted through said ring and looped back over said strap thereafter temporarily attached by hook and loop material disposed upon facing surfaces of said strap.

3. A sports sandal according to claim 1 wherein said second means comprises a strap having a free end and an end which is attached to the first strip; the other strip further having a ring attached whereby said free end is inserted through said ring and looped back over said strap thereafter temporarily attached by hook and loop material disposed upon facing surfaces of said strap.

4. A sports sandal comprising:

a sole;

a pair of substantially arc-shaped front strips positioned on opposing lateral sides of said sole, the ends of said strips anchored to said sole;

a pair of substantially arc-shaped rear strips positioned on opposing lateral sides of said sole, the ends of said strips anchored to said sole;

a layer of cushion material having a first end section, a second end section and a center section, said first end section and said second end section attached to the respective inside surface of said front strips; said center portion further defining an open space between said cushion material and said sole;

a second layer of cushion material having a first end section, a second end section and a center section, said first end section and said second end section attached to the respective inside surface of said rear strips; said center portion further defining an open space between said cushion material and said sole;

a first means for selectively adjusting said front pair of strips about a wearer's foot;

a second means for selectively adjusting said rear pair of strips about a wearer's ankle;

a strap means for wrapping about the wearer's heel; and said rear pair of strips further having an aperture; one end of each said front pair of strips being inserted through a slit on the respective rear strip prior to said strip end being attached to said sole.

5. A sports sandal according to claim 4 wherein said first means comprises a strap having a free end and an end which is attached to the first strip; the other strip further having a ring attached whereby said free end is inserted through said ring and looped back over said strap thereafter temporarily attached by hook and loop material disposed upon facing surfaces of said strap.

6. A sports sandal according to claim 4 wherein said second means comprises a strap having a free end and an end which is attached to the first strip; the other strip further having a ring attached whereby said free end is inserted through said ring and looped back over said strap thereafter temporarily attached by hook and loop material disposed upon facing surfaces of said strap.

7. A sports sandal comprising:

a sole;

a pair of substantially arc-shaped front strips positioned on opposing lateral sides of said sole, the ends of said strips anchored to said sole;

a pair of substantially arc-shaped rear strips positioned on opposing lateral sides of said sole, the ends of said strips anchored to said sole;

a layer of cushion material having a first end section, a second end section and a center section, said first end section and said second end section attached to the respective inside surface of said front strips; said center portion further defining an open space between said cushion material and said sole;

a second layer of cushion material having a first end section, a second end section and a center section, said first end section and said second end section attached to the respective inside surface of said rear strips; said center portion further defining an open space between said cushion material and said sole;

a first means for selectively adjusting said front pair of strips about a wearer's foot;

a second means for selectively adjusting said rear pair of strips about a wearer's ankle;

a strap means for wrapping about the wearer's heel; and said front pair of strips further having an aperture; one end of each said front pair of strips being inserted through a slit on the respective rear strip prior to said strip end being attached to said sole.

8. A sports sandal according to claim 7 wherein said first means comprises a strap having a free end and an end which is attached to the first strip; the other strip further having a ring attached whereby said free end is inserted through said ring and looped back over said strap thereafter temporarily attached by hook and loop material disposed upon facing surfaces of said strap.

9. A sports sandal according to claim 7 wherein said second means comprises a strap having a free end and an end which is attached to the first strip; the other strip further having a ring attached whereby said free end is inserted through said ring and looped back over said strap thereafter temporarily attached by hook and loop material disposed upon facing surfaces of said strap.

10. A sports sandal comprising:

a sole;

a pair of substantially arc-shaped front strips positioned on opposing lateral sides of said sole, each front strip having a front section with an end and a rear section with an end, the ends of said strips being anchored to said sole;

a pair of substantially arc-shaped rear strips positioned on opposing lateral sides of said sole, each rear strip having a front section with an end and a rear section with an end, the ends of said rear strips being anchored to said sole, and on each lateral side of the sole, said rear section of the front strip overlapping a portion of the front section of the rear strip; and a means for connecting said front strip to said corresponding rear strip at the overlapping portions of the front and rear strips on the same lateral side of said sole.

* * * * *